US012022889B2

(12) United States Patent
Wahidi

(10) Patent No.: US 12,022,889 B2
(45) Date of Patent: Jul. 2, 2024

(54) SMOKING SYSTEM INCLUDING RIGID MOUTHPIECE AND FLAVOR RELEASING MECHANISM

(71) Applicant: AIDEMAR GROUP, INC., Vernon, CA (US)

(72) Inventor: Jawid Wahidi, Irvine, CA (US)

(73) Assignee: AIDEMAR GROUP, INC., Vernon, CA (US)

( * ) Notice: Subject to any disclaimer, the term of this patent is extended or adjusted under 35 U.S.C. 154(b) by 8 days.

(21) Appl. No.: 17/902,117

(22) Filed: Sep. 2, 2022

(65) Prior Publication Data

US 2024/0074492 A1 Mar. 7, 2024

(51) Int. Cl.
*A24F 7/00* (2006.01)
*A24F 7/02* (2006.01)
*A24F 7/04* (2006.01)

(52) U.S. Cl.
CPC . *A24F 7/04* (2013.01); *A24F 7/02* (2013.01)

(58) Field of Classification Search
None
See application file for complete search history.

(56) References Cited

U.S. PATENT DOCUMENTS 3,122,145 A * 2/1964 St Louis ..... A24F 13/06 131/337
3,339,557 A * 9/1967 Karalus ..... A24D 3/061 131/342
4,319,590 A * 3/1982 Patarra ..... A24D 3/04 131/202
2011/0120483 A1* 5/2011 Blick et al. ..... B65D 85/1081 206/236

FOREIGN PATENT DOCUMENTS

KR 102066433 B1 * 2/2020 ..... A24D 1/002

* cited by examiner

*Primary Examiner* — Dionne W. Mayes
(74) *Attorney, Agent, or Firm* — Cohen IP Law Group, PC; Michael N. Cohen

(57) ABSTRACT

A smoking system including a mouthpiece with a flavor releasing mechanism in its inner volume is provided. The mouthpiece includes a rigid material (e.g., glass or ceramic) that may be coupled to a smokable rod or cone. A force-applying member is located within the inner volume adjacent the flavor ball and is coupled to an elongate movable member extending out an end of the mouthpiece. Movement of the elongate movable member causes the force-applying member to apply a force to the flavor ball causing the ball to burst. Once the flavor ball bursts, the ball releases its flavoring substance into smoke passing through the mouthpiece to enhance the smoking experience.

17 Claims, 8 Drawing Sheets

SMOKING SYSTEM INCLUDING RIGID MOUTHPIECE AND FLAVOR RELEASING MECHANISM

FIELD OF THE INVENTION

The present invention relates to smokable rods and cones, including smokable rods and cones with rigid mouthpieces and embedded flavor releasing mechanisms.

BACKGROUND

A new phenomenon is happening within the smokables industry involving the inclusion of flavor releasing mechanisms within the mouthpiece of a smokable rod or cone. In many cases, the flavor releasing mechanisms include small spheres filled with a flavoring substance (also known as "click balls" or flavor balls) that are designed to be squeezed by the user to effectively explode and release the flavoring into the smoke.

However, many users prefer rigid mouthpieces, e.g., glass or ceramic, compared to the softer paper mouthpieces required to enable the squeezing and bursting of the flavor balls inside. However, because the rigid mouthpieces cannot be squeezed, these mouthpieces cannot be used with the flavor balls in the same manner as the paper mouthpieces.

Accordingly, there is a need for a smoking system including a rigid mouthpiece assembly able to activate one or more flavor releasing mechanisms to maximize the smoking experience.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

For the purposes of this specification, the terms below will mean the following.

Cigarette generally refers to a smokable comprising a thin cylinder of finely cut tobacco, cannabis, other types of leaves, flowers, herbs, and/or other smokable materials, rolled in a suitable paper or leaf for smoking. A cigarette may or may not include a mouthpiece (e.g., an insert, a filter, etc.).

Cigar generally refers to a cylinder of tobacco rolled in tobacco leaves for smoking. A cigar may or may not include a mouthpiece (e.g., an insert).

Blunt generally refers to a cigar that has been hollowed out and filled with other types of smokable materials (e.g., cannabis). A blunt may typically include a mouthpiece, such as the insert system described herein, however, this may not be necessary.

Cone generally refers to a conical- or frustum-shaped cigarette (or "joint") wherein the shape flares from a smaller diameter proximal base to a larger diameter distal tip. Cones may typically comprise paper, hemp, palm leaves, tobacco leaves, rice, cotton, cellulose, glycerin, and/or other suitable materials.

Pre-roll generally refers to a cigarette or cone that has been formed prior to its sale and is therefore consumer-ready (i.e., a consumer is not required to fill or otherwise form the smokable).

Empty cone refers to an empty cone into which a consumer may place smokable materials (e.g., tobacco, cannabis, etc.) to form a smokable cone.

Insert generally refers to a mouthpiece or tip coupled with a cone, blunt or cigarette that acts to support the proximal end of the smokable (e.g., the end that is pressed against one's lips for smoking). An insert may include a "crutch" formed of thick paper, glass or other materials, a filter (e.g., a cotton filter), other types of inserts, and any combinations thereof. Inserts may be used with cigarettes, blunts, cones (pre-rolled, empty, etc.), rolling papers, and other types of smokable items.

In general, and according to exemplary embodiments hereof, a smoking system including a mouthpiece assembly with a flavor releasing mechanism (e.g., a flavor ball) is provided. The mouthpiece assembly comprises a rigid material (e.g., glass or ceramic) including a flavor ball within its inner volume. A force-applying member is located within the inner volume adjacent the flavor ball and is coupled to an elongate movable member extending out the end of the mouthpiece. Movement of the elongate movable member causes the force-applying member to apply a force to the flavor ball causing the ball to burst. Once the flavor ball bursts, the ball releases its flavoring substance into the smoke passing through the mouthpiece to enhance the smoking experience.

Figure 1:
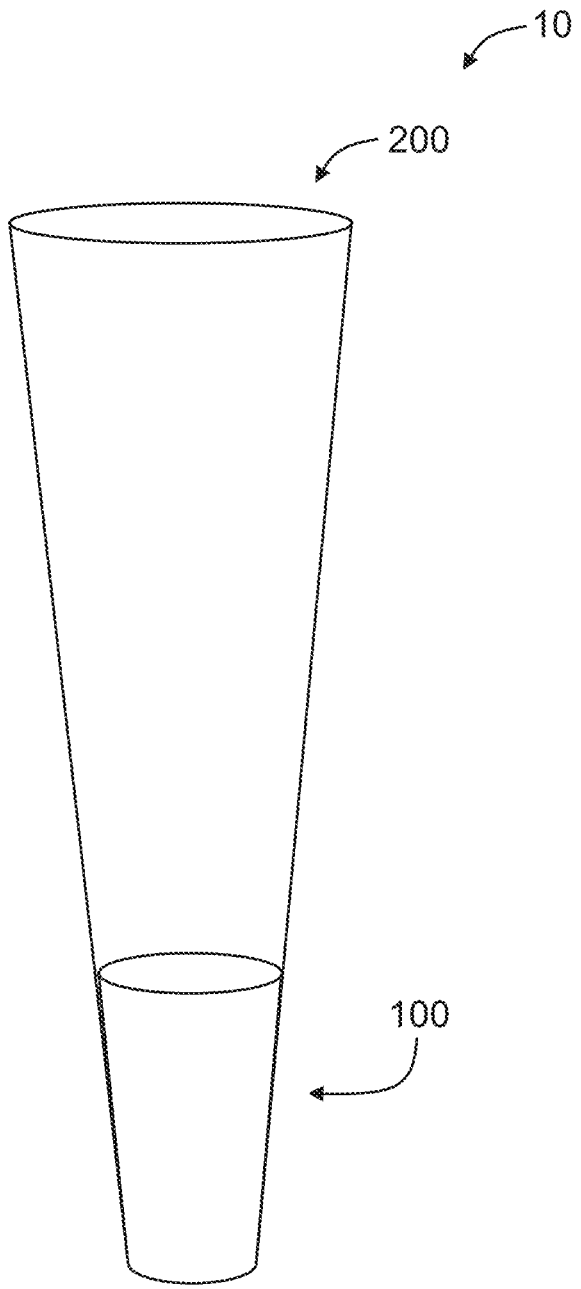
FIG. 1 show aspects of a smoking system according to exemplary embodiments hereof.
Figure 2:
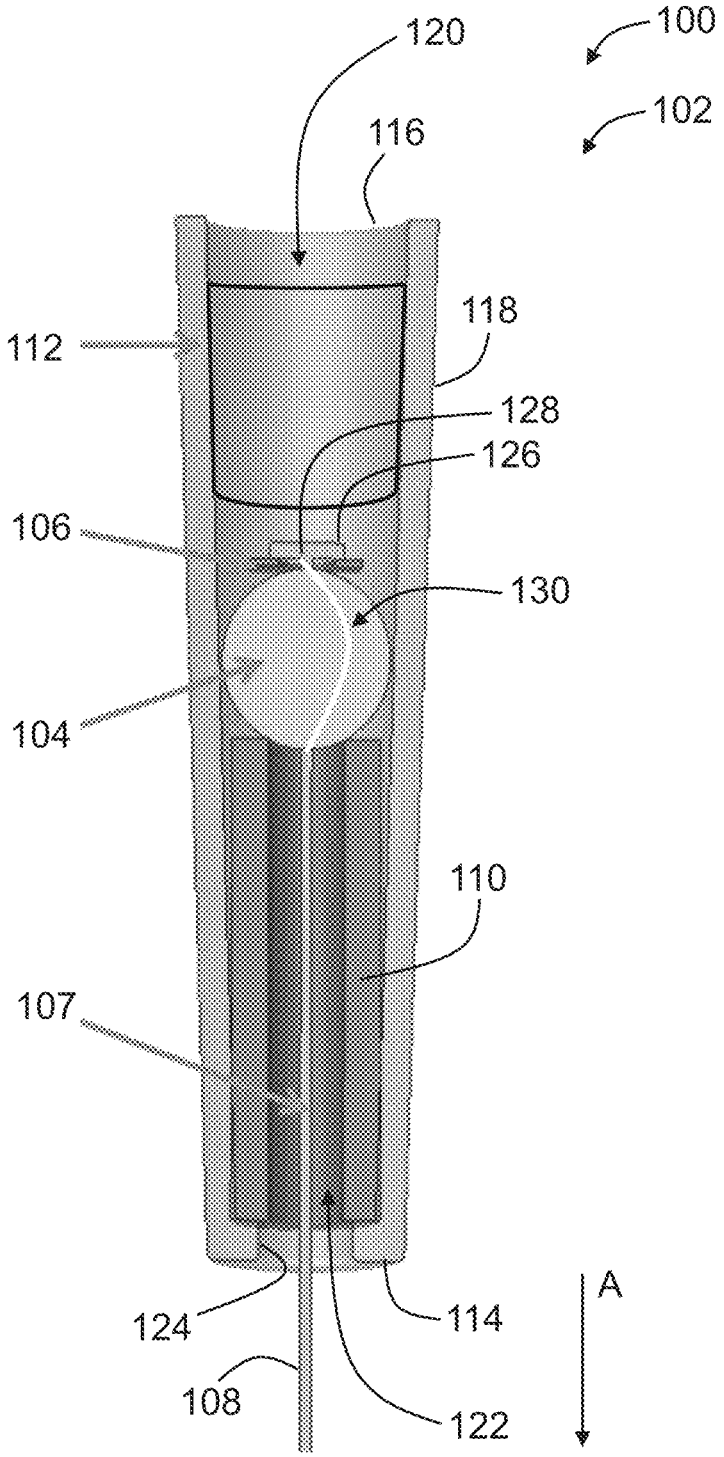
FIG. 2 shows aspects of a mouthpiece assembly according to exemplary embodiments hereof.

In one exemplary embodiment hereof as shown in FIGS. 1 and 2, the smoking system 10 (also referred to herein as simply the system 10) includes a mouthpiece assembly 100 and a smokable rod or cone 200. The mouthpiece assembly 100 comprises a rigid material (e.g., glass) and includes one or more flavor releasing mechanisms 104 (see FIG. 2). As will be described herein, the flavor releasing mechanism 104 may be burst by the user to release a flavoring substance to enhance the smoking experience. The smokeable rod or cone 200 (see FIG. 1) may include any type of smokable, including, but not limited to, a blunt, a cigar, a cigarette, a cone, a pre-roll, an empty cone, empty pre-roll, any other type of smokable, and any combinations thereof. The smoking system 10 also may include other elements to fulfill its functionalities as described herein.

Mouthpiece Assembly 100

FIG. 1 is a schematic of a smoking system 10 including a mouthpiece assembly 100 and a cone 200. FIG. 2 is a side sectional view of the mouthpiece assembly 100 of FIG. 1, and FIG. 3 is an exploded view of the same.

Figure 3:
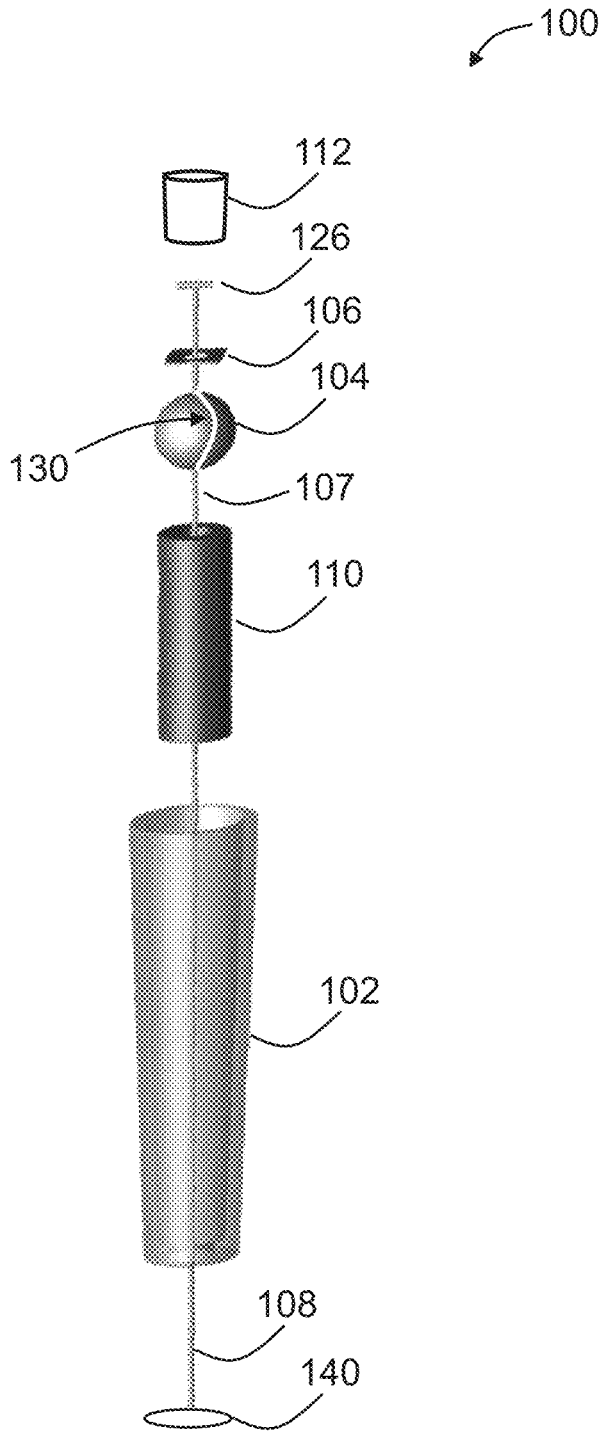
FIG. 3 shows an exploded view of the mouthpiece assembly of FIG. 2 according to exemplary embodiments hereof.

In some embodiments, as shown in FIGS. 2-3, the mouthpiece assembly 100 includes a mouthpiece body member 102, a flavor releasing mechanism 104, a force-applying member 106 (e.g., a blade or head), an elongate movable member 107, a first spacer 110, and a second spacer 112.

The mouthpiece body member 102 includes an open first end 114, an open second end 116, and sidewalls 118 extending between the first and second ends 114, 116 defining an inner volume 120. The first and second ends 114, 116 are in fluid communication with one another through the inner volume 120. In some embodiments, the mouthpiece body member 102 comprises glass, ceramic, plastic, and/or other suitable rigid materials. In this way, the body member 102 is generally rigid. However, in other embodiments, the mouthpiece body 102 comprises less-rigid materials such as cardboard, paper, hemp, leaves, a polymer (e.g., silicone), other suitable materials, and any combinations thereof.

In some embodiments, the body member 102 is formed as a conical frustum with a generally circular cross section of increasing diameter from its first end 114 to its second end 116. Being a conical frustum, the diameter of the first end 114 is preferably smaller than the diameter of the second end 116.

In other embodiments, the body member 102 is formed as a cylinder with a generally circular cross section with a generally constant diameter from its first end 114 to its second end 116. It also is understood that the body member 102 may be formed as any combination of frustum shaped and cylindrical shaped, and/or any other shapes.

In some embodiments, the first spacer 110 is located within the inner volume 120 at the first end 114. The first spacer 110 may be formed as a conical frustum that generally corresponds to the form of the inner volume 120 in which it resides, while in other embodiments, the first spacer 110 may be cylindrical, tubular, a rectangular prism, a cuboid, other shapes that generally fill the area of the inner volume 120 in which the spacer 110 resides, and any combinations thereof. It may be preferable that the first spacer 110 is formed of a compressible material such as cotton, foam, silicone, or other suitable materials so that the spacer 110 may generally fit snugly within the inner volume 120.

In some embodiments, the first spacer 110 preferably includes a through-hole 122 passing longitudinally through the spacer 110 from its top end to its bottom end. In this way, the first spacer 110 may be generally tubular. However, this may not be required.

In some embodiments, as shown in FIG. 2, the body member's first end 114 includes a circumferential rim 124 that faces inward into the inner volume 120 (e.g., 0.5 mm-2.0 mm). As shown in FIG. 2, the bottom end of the first spacer 110 generally abuts the circumferential rim 124 and is thereby prevented from passing through the first opening 114 and out of the inner volume 120. However, because the circumferential rim 124 only extends partway across the open first end 114, the first end 114 remains open. Note that the circumferential rim 124 also may comprise a grid, screen, and/or other type of structure that may prevent the first spacer 110 from passing through the first opening 114.

In some embodiments, as shown in FIG. 2, the flavor releasing mechanism 104 is located within the inner volume 120 adjacent to and/or above the first spacer 110 as shown in FIG. 2. In some embodiments, the flavor releasing mechanism 104 includes any type of solid, liquid, and/or gas (and any combinations thereof) that may release one or more flavors when activated. The mechanism 104 may be designed to be activated by heat (e.g., during smoking), by pressure (e.g., may be squeezed, pricked, pulled apart, or otherwise burst, etc.), by other activation techniques, and by any combinations thereof. The flavor releasing mechanism 104 is sized to fit within the body member's inner volume 120 but preferably is too large to fit into or through the first spacer's longitudinal through-hole 122.

In some embodiments, as shown in FIGS. 2-3, the flavor releasing mechanism 104 includes a flavor ball comprising a crushable spherical container with a flavoring substance inside. The flavor ball may be adapted to generally burst (or otherwise open) when squeezed thereby releasing the flavoring substance. In this way, a user may cause the mechanism 104 to burst within the insert body member 102 when a flavoring is desired during the smoking experience. While the flavor releasing mechanism 104 is depicted in FIGS. 2-3 as a sphere, it is understood that the flavor releasing mechanism 104 may include any shape and/or form as desired.

It also is understood that any other type(s) and/or shapes of flavor releasing mechanisms 104 may be used with the insert 10, and that the scope of the insert 10 is not limited in any way by the type of flavor releasing mechanism(s) used. It also is understood that any number of flavor releasing mechanisms 104 may be used, and when multiple flavor releasing mechanisms 104 are included, the other elements of the mouthpiece assembly 100 may be duplicated and/or rearranged as necessary in order to activate the multiple flavor releasing mechanisms 104 as described herein. For example, additional force-applying members 106 may be configured with the elongate movable member 107 (e.g., one force-applying member 106 for each flavor releasing mechanism 104) in order to cause the additional flavor releasing mechanisms 104 to burst when desired.

In some embodiments, as shown in FIG. 2, the force-applying member 106 is located within the inner volume 120 adjacent to and/or above the flavor releasing mechanism 104. The force-applying member 106 includes a small blade, plate, tab, wedge, and/or other suitably shaped member comprising metal, plastic, glass, ceramic, wood, other suitable materials, and/or any combinations thereof. In some embodiments, the force-applying member 106 may include one or more sharpened edges, but this may not be necessary. As described below, the purpose of the blade member 106 is to apply pressure and/or a sharpened edge to the flavor releasing mechanism 104 thereby causing it to burst when desired.

In some embodiments, as shown in FIGS. 2-3, the elongate movable member 107 includes a pull member 108. The pull member 108 includes a line or other type of elongate structure with a first end that is coupled to the force-applying member 106 such that the pull member 108 extends from the force-applying member 106 past the flavor releasing mechanism 104, through the first spacer's through-hole 122, and out the body member's first open end 114. The pull member 108 may include a thin line of plastic, wire, rubber, string, chain, and/or other suitable types of elongate structures. In embodiments in which the first spacer 110 does not necessarily include a through-hole 114, the pull member 108 may simply pass to the side of the first spacer 110 between the first spacer 110 and the inner surface of the body member's sidewall 118.

In some embodiments, as shown in FIGS. 2-3, the pull member 108 includes a tab 126 at its first end within the inner volume 120 that facilitates the coupling of the pull member 108 with the force-applying member 106. For example, in some embodiments, the force-applying member 106 includes a through-hole 128 that the main portion of the pull member 108 may pass through. However, the tab 126 preferably includes a width greater than the diameter of the through-hole 128 so that the tab 126 may not pass through the hole 128 in the force-applying member 106. In this way, the tab 126 is held against an upper surface of the force-applying member 106 while the remaining portion of the pull member 108 passes through the force-applying member 106, past the flavor releasing mechanism 104, through the first spacer 110 and out the open first end 114 of the mouthpiece assembly 100. In some embodiments, the pull member 108 is connected directly to the force-applying member 106.

In some embodiments, the second spacer 112 is located within the body member's inner volume 120 towards the second end 116 (the top end as shown in FIG. 2). In some embodiments, the second spacer 112 may be formed as a conical frustum that generally corresponds to the form of the inner volume 120 in which it resides, while in other embodiments, the second spacer 112 may be cylindrical, tubular, a rectangular prism, a cuboid, other shapes that generally fill the area of the inner volume 120 in which the spacer 110 resides, and any combinations thereof. It may be preferable that the second spacer 112 is formed of a compressible material such as cotton, foam, silicone, plastic, or other suitable materials so that the spacer 112 may generally fit snugly within the inner volume 120. However, it is understood that the second spacer 112 may be formed using any suitable material(s).

As mentioned above, the purpose of the force-applying member 106 and the pull member 108 is to cause the flavor releasing mechanism 104 to burst when desired. To facilitate this, in some embodiments, a user may grasp a portion of the pull member 108 extending out the open first end 114 of the mouthpiece body member 102 (see FIG. 2) and pull downward in the direction of the arrow A. In some embodiments, the pull member 108 may include a handle 140 coupled to its outer end providing an area for the user to grip.

As the pull member 108 moves downward, the force-applying member 106 is forced downward against the flavor releasing mechanism 104. Because the flavor releasing mechanism 104 is secured between the force-applying member 106 and the upper end of the first spacer 110, and because the first spacer 110 is held in place by the mouthpiece body's lower circumferential rim 124, the flavor releasing mechanism 104 is squeezed between the force-applying member 106 and the first spacer 110. When adequate pressure is applied to the flavor releasing mechanism 104 by the pulling of the pull member 108, the flavor releasing mechanism 104 will burst and release its flavor substance.

In some embodiments, the released flavor substance generally remains within the mouthpiece's inner volume 120 between the first spacer 110 and the second spacer 112. In some embodiments, the first and/or second spacers 110, 112 include absorbent materials that may absorb and/or generally hold the released flavor substance within the inner volume during the smoking experience. In other embodiments, the first and/or second spacers 110, 112 include non-absorbent materials that may not absorb the released flavor substance so that the released flavor substance may simply remain within the inner volume 120 separately. In other embodiments, the first and/or second spacers 110, 112 include filter materials to filter the smoke passing through the spacers 110, 112. It is understood that the first and second spacers 110, 112 may include any type(s) of suitable materials as desired. In other embodiments, the flavor releasing mechanism 104 is held within a small tubular (or other shaped) absorption member that may absorb at least some of the released flavor substance. In some embodiments, the absorption member may comprise cotton or other suitable materials.

In some embodiments, the tab 126 is designed to break from the end of the pull member 108 when adequate downward force is applied to the pull member 108. If the pull member 108 is connected directly to the force-applying member 106, the junction between the end of the pull member 108 and the force-applying member 106 is designed to break when adequate force is applied. However, it is preferred that the minimum force required to break the tab 126 from the end of the pull member 108 (or to break the junction between the force-applying member 106 and the end of the pull member 108) is greater than the minimum force required to burst the flavor releasing mechanism 104. In this way, as downward force is applied to the pull member 108, the flavor releasing mechanism 104 will burst first, and as a further amount of force is applied to the pull member 108 after the bursting of the flavor releasing mechanism 104, the tab 126 may break from the end of the pull member 108 (or the pull member 108 will break from the force-applying member 106) allowing the pull member 108 to be pulled out and generally removed from the mouthpiece assembly 100.

Given the above, it is understood that the force-applying member 106 may include any shape and/or form that when pulled downward causes the flavor releasing mechanism 104 to burst. For example, the force-applying member 106 may include a spherical bead, a cuboid, a plate, a wedge, a pyramid, any other type of polygon, any other suitable shape or form, and any combinations thereof.

As shown in FIG. 2, in some embodiments, a line portion 130 of the pull member 108 passes from the force-applying member 106 over the outer curvature of the flavor releasing mechanism 104 (e.g., over the outer curvature of the flavor ball). Accordingly, it is preferable that the force-applying member 106 is sized large enough to not pass past the flavor ball 104 as the pull member 108 is pulled downward, but instead, to apply adequate pressure against the flavor ball 104 to cause the flavor ball 104 to burst.

Figure 4:
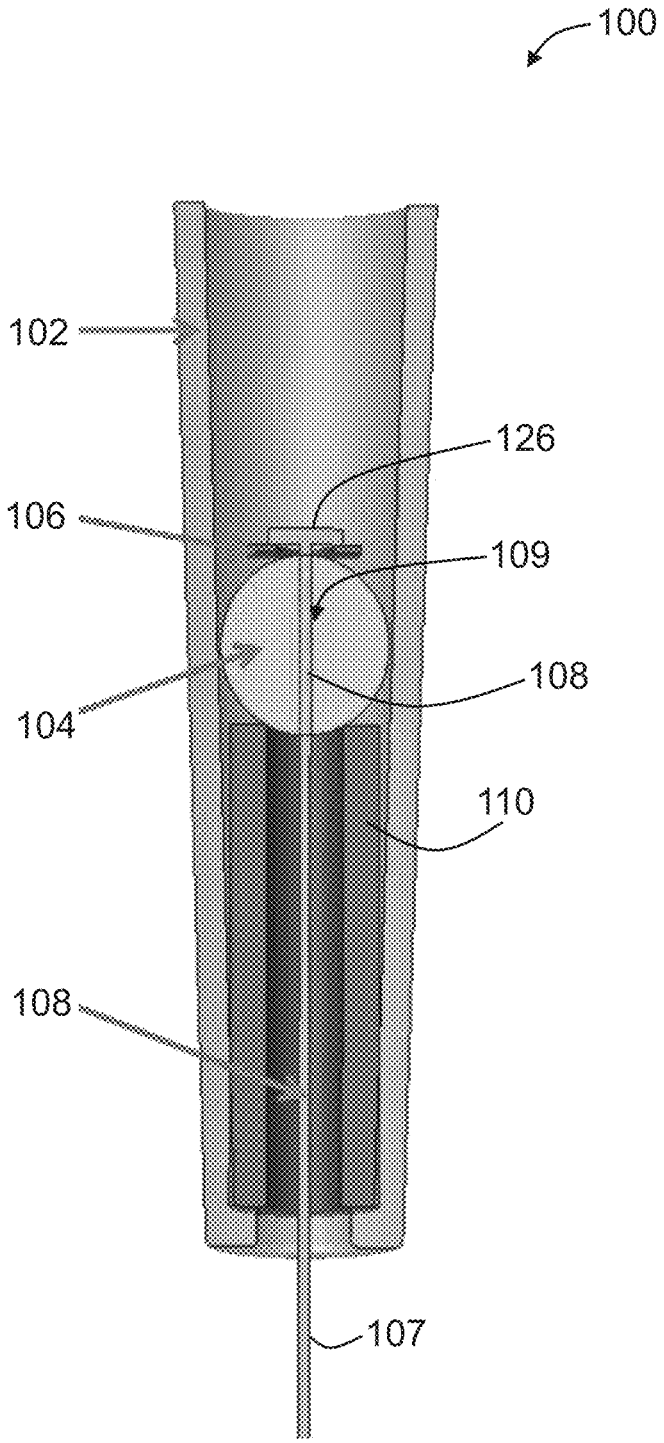
FIG. 4 shows aspects of a mouthpiece assembly according to exemplary embodiments hereof.

In other embodiments, as shown in FIG. 4, the flavor releasing mechanism 104 includes a through-hole 109, e.g., the flavor releasing mechanism 104 includes a bead with a through-hole, such that the pull member 108 extends through the flavor ball's through-hole 109. In this way, the portion 130 of the pull member 108 that passes over the outer curvature of the flavor ball 104 may not exist.

In some embodiments, the first and/or second spacers 110, 112, include smoke filtering materials, such as, without limitation, cotton, cellulose acetate, other types of filter materials or tow materials, and any combinations thereof. The first and/or second spacers 110, 112 also may include one or more plant materials, such as, but not limited to, husk material, leaf material, stalk material, stem material, seed material, vegetable material, fruit material, other types of plant material(s), and any combinations thereof. In other embodiments, the spacers 110, 112 comprise plastic, ceramic, and/or other more rigid materials with through-holes passing through the spacers 110, 112 to allow the smoke to pass therethrough. In any event, it is understood that the first and second spacers 110, 112 are generally porous (or include through-holes if the spacers 110, 112 comprise plastic or other solid materials) to allow smoke to pass through the body member's inner volume 120 from the second end 116 to the first end 114 while preferably filtering the smoke. It is understood that filtering of the smoke also may include blocking particles of the smokable material that may not be fully combusted (e.g., parts of the smokable plant material).

Figure 5:
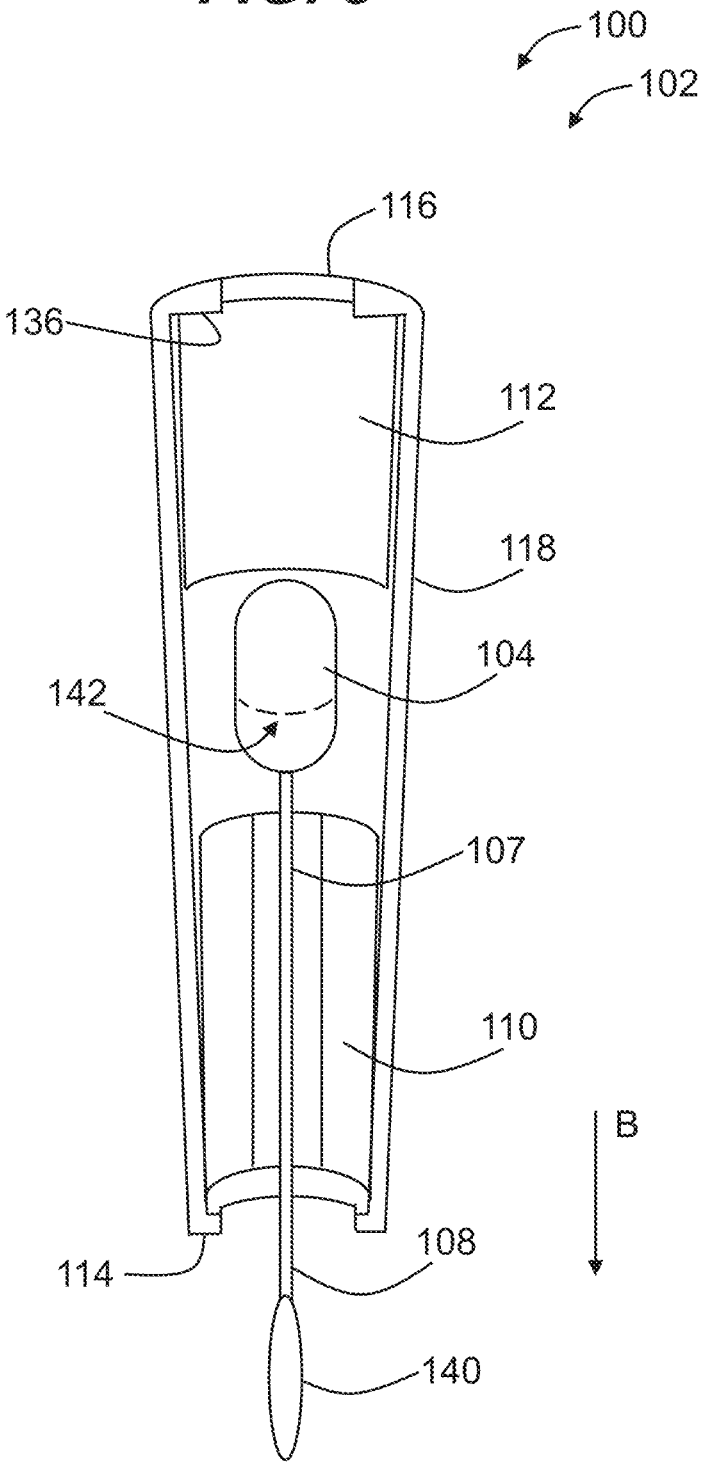
FIG. 5 shows aspects of a mouthpiece assembly according to exemplary embodiments hereof.

In some embodiments, as shown in FIG. 5, the flavor releasing mechanism 104 is designed to break apart (e.g., tear open) when pulled upon. To represent this, the flavor releasing mechanism 104 is shown as pill-shaped to differentiate this functionality from other types of flavor releasing mechanisms 104 described herein (e.g., the flavor ball). However, it is understood that is done for demonstration and that the flavor releasing mechanism 104 may include any shape and/or form.

In some embodiments, the inner end of the pull member 108 is attached directly to the flavor releasing mechanism 104, e.g., to the lower end of the mechanism 108. Accordingly, when the pull member 108 is pulled downward in the direction of the arrow B, the pull member 108 effectively causes the flavor releasing mechanism 104 to stretch and break, thereby releasing the flavoring substance.

In some embodiments, the flavor releasing mechanism 104 includes a weakened area 142, e.g., a horizontal circumferential perforation, that is designed to break upon a predetermined amount of force being applied to the mechanism 104 by the pull member 108. In this way, as the pull member 108 is pulled downward, the flavor releasing mechanism 104 is caused to break open and release the flavoring substance.

In some embodiments, when the flavor releasing mechanism 104 is caused to open, the pull member 108 preferably detaches from the flavor releasing mechanism 104 so that the member 108 may be removed from the mouthpiece body 102.

Figure 6:
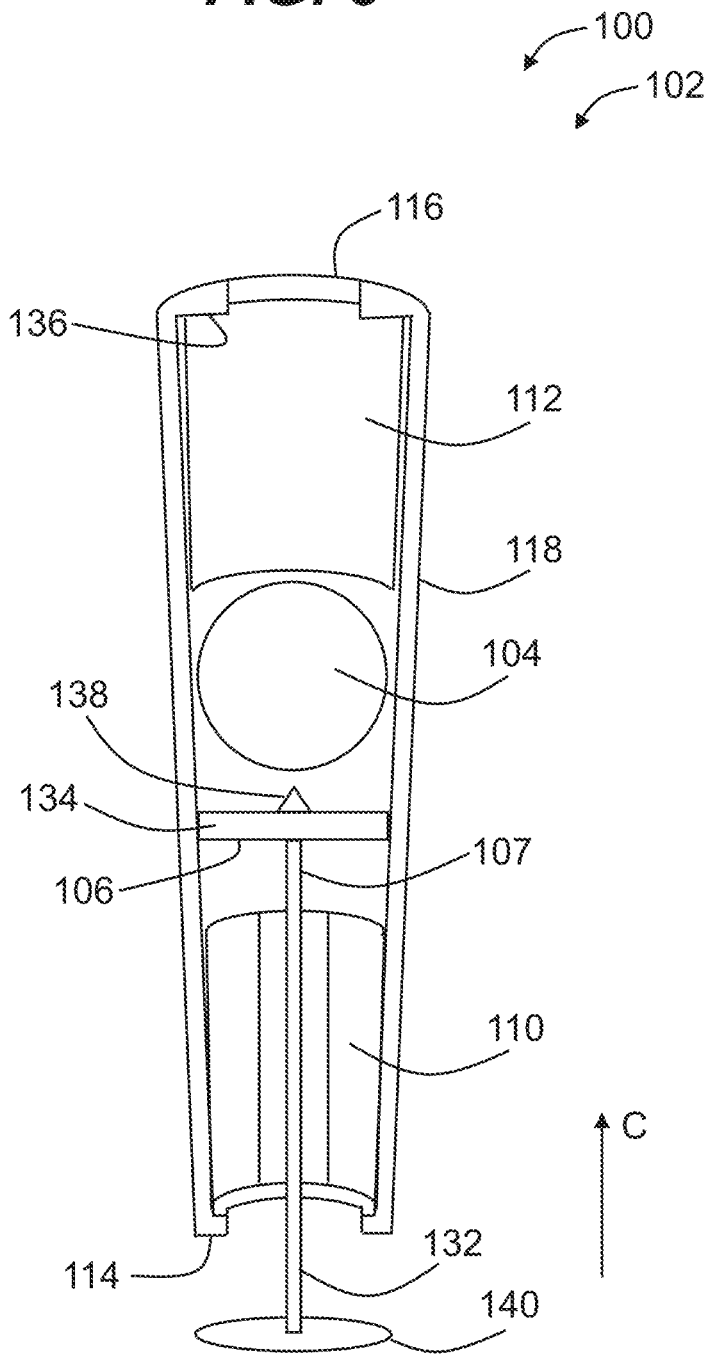
FIG. 6 shows aspects of a mouthpiece assembly according to exemplary embodiments hereof.

In some embodiments, as shown in FIG. 6, the elongate movable member 107 includes a push member 132. In some embodiments, the push member 132 may replace the pull member 108. In this case, the push member 132 facilitates the bursting of the flavor releasing mechanism 104 instead of the pull member 108.

In some embodiments, the push member 132 includes a rod or other type of elongate structure including a force-applying member 106 coupled to its first end located within the mouthpiece's inner volume 120 adjacent and below the flavor releasing mechanism 104. In this scenario, the force-applying member 106 may be referred to as a head 134. In some embodiments, the force-applying member 106 (e.g., the head 134) may simply include the inner end of the push member 132. The push member 132 extends from its head 134 through the first spacer's through-hole 122, and out the body member's first open end 114. The push member 132 may comprise plastic, rubber, wood, paper, or other suitable materials. In embodiments in which the first spacer 110 does not necessarily include a through-hole 114, the push member 132 may simply pass to the side of the first spacer 110 between the first spacer 110 and the inner surface of the body member's sidewall 118.

In some embodiments, the push member 132 includes a handle 140 coupled to its second end providing an area for the user to grip.

In some embodiments, as the push member 132 is pushed upward in the direction of the arrow C and further into the mouthpiece's inner volume 120, the member's head 134 applies a force to the bottom of the flavor releasing mechanism 104 to burst the mechanism 104 thereby releasing its flavoring substance. In some embodiments, as shown in FIG. 6, the body member's second end 116 includes a circumferential rim 136 that faces inward into the inner volume 120 (e.g., 0.5 mm-2.0 mm). As shown, the top end of the second spacer 112 generally abuts the circumferential rim 136 and is thereby prevented from passing through the second opening 116 and out of the inner volume 120. In this way, the second spacer 112 is held in place as the force is applied to the flavor releasing mechanism 104 thereby pressing the flavor mechanism 104 against the stationary second spacer 112 and causing the flavor mechanism 104 to burst. Because the circumferential rim 136 only extends partway across the second end 116, the second end 116 remains open.

In some embodiments, as shown in FIG. 6, the upper portion of the push member's head 134 includes a piercing structure 138 (e.g., a spike) or other type of structure that when pressed against the flavor releasing mechanism 104 may pierce the mechanism 104 causing it to burst.

In some embodiments, after the flavor releasing mechanism 104 has been burst, the user may pull the push member 132 downward and out of the mouthpiece body 102. In this case, it may be preferable that the head 134 of the push member 132 collapse and/or break off so that the push member 132 may pass through the first spacer 110 and out the mouthpiece body 102.

In some embodiments, the elongate movable member 107 (e.g., either the pull member 108 and/or the push member 132) may pass from within the body member's inner volume 120 to outside the body member 102 through the open second end 116 instead of, or in addition to, the open first end 114. It is understood that the elements within the mouthpiece body member 102 may be rearranged so that the functionalities described herein may be realized as the elongate movable member 107 is pulled and/or pushed through the open second end 116 to activate the flavor releasing mechanism 104.

Figure 7:
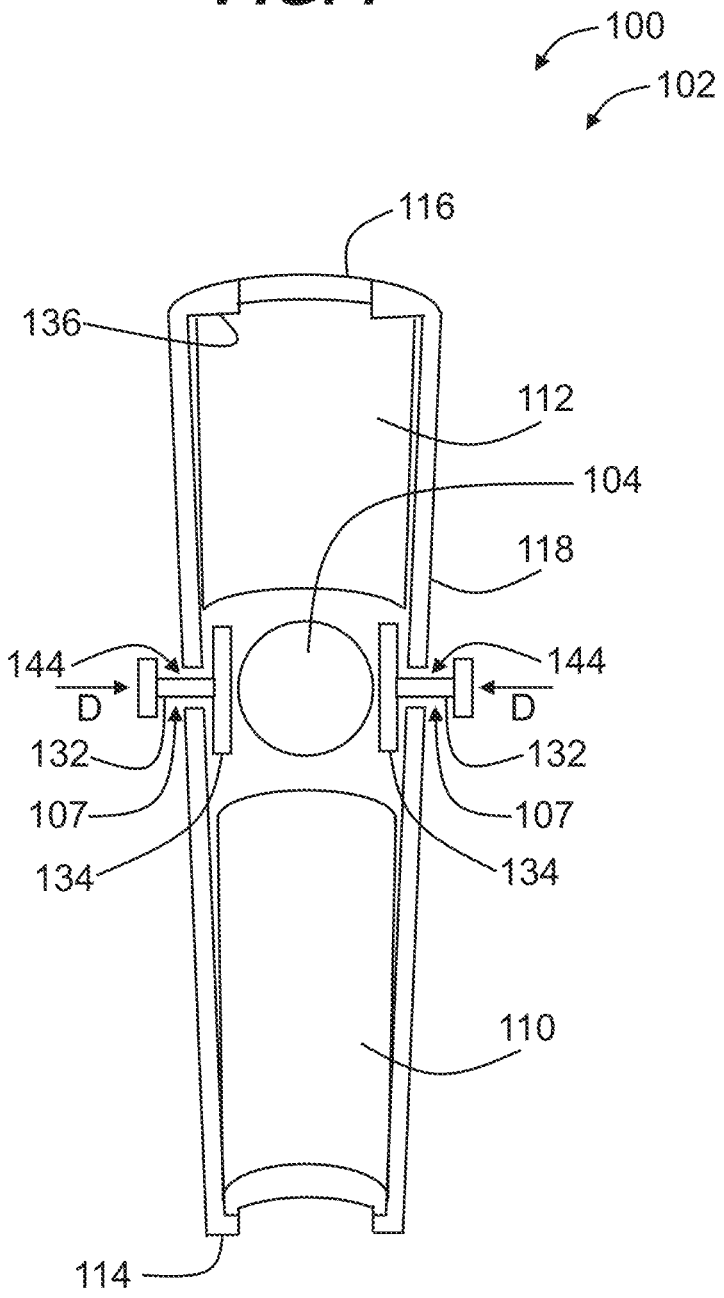
FIG. 7 shows aspects of a mouthpiece assembly according to exemplary embodiments hereof.
Figure 8:
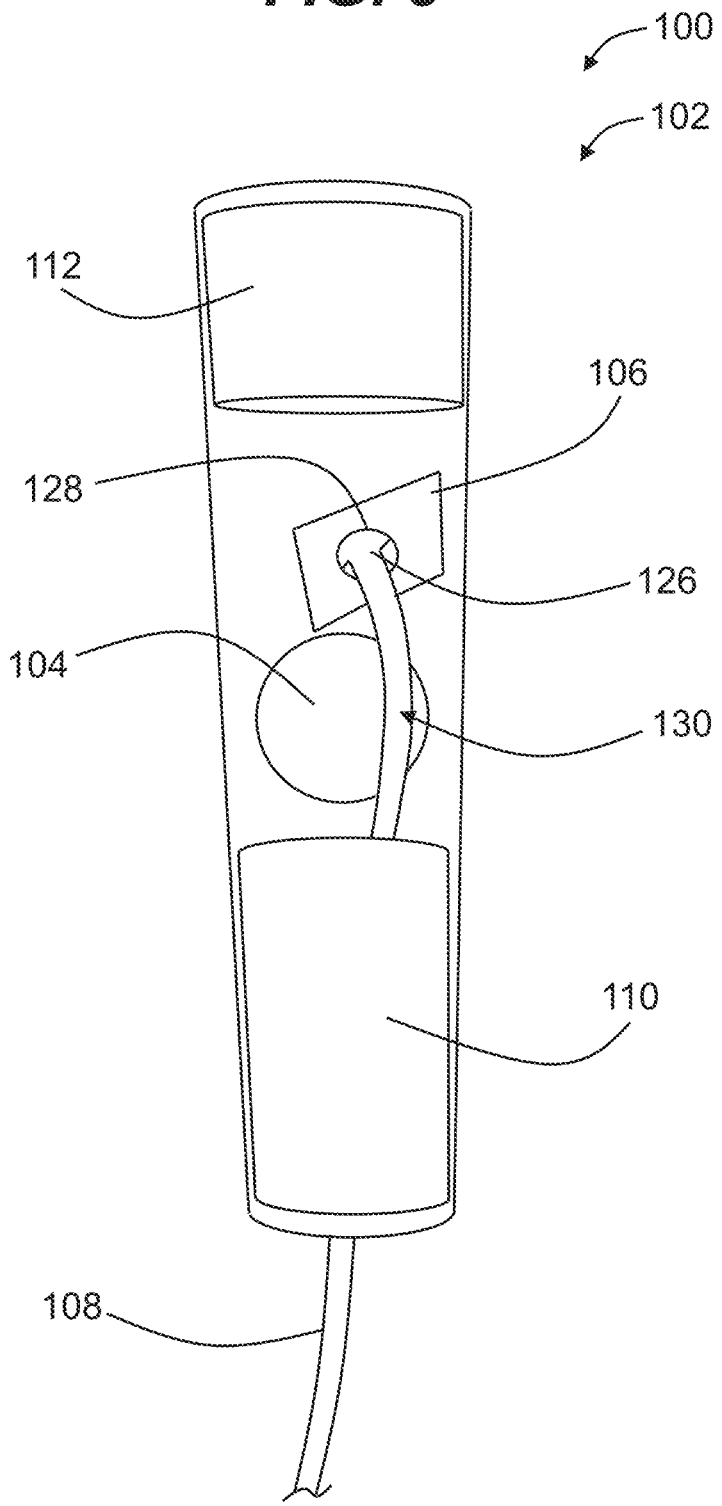
FIG. 8 shows an image of a mouthpiece assembly according to exemplary embodiments hereof according to exemplary embodiments hereof.

In some embodiments, as shown in FIG. 7, the mouthpiece body member 102 includes one or more side holes 144 located in the sidewalls 118 through which the elongate movable member 107 (e.g., either the pull member 108 and/or the push member 132) may pass from within the body member's inner volume 120 to outside the body member 102. In this way, the elongate movable member 107 may not necessarily pass through the first and/or second ends 114, 116. It is understood that the elements within the mouthpiece body member 102 may be rearranged so that the functionalities described herein may be realized as the elongate movable member 107 is pulled and/or pushed through the side hole to activate the flavor releasing mechanism 104.

For example, in some embodiments, as shown in FIG. 7, the elongate movable member 107 includes one or more push members 132 that pass through the side holes 144 on the mouthpiece body member 102, that when pushed inward in the direction of the arrows D, apply pressure to the flavor releasing mechanism 104 thereby causing the mechanism 104 to burst and release its flavoring substance. In some embodiments, the push members 132 may be spring loaded so that the members 132 generally return to their initial outward positions when released, but this may not be necessary.

In some embodiments, as shown in FIG. 7, the push members 132 each including a head 134 that makes contact with the flavor releasing mechanism 104 when pushed inward thereby causing the flavor mechanism 104 to burst. It also is contemplated that the push members 132 and/or the heads 134 include piercing structure 138 (e.g., a spike) or other type of structure that when pressed against the flavor releasing mechanism 104 may pierce the mechanism 104 causing it to burst.

It also is contemplated that the elongate movable member 107 of FIG. 7 is attached directly to the flavor releasing mechanism 104 such that when pulled outward (in the direction opposite to the arrows D), the elongate movable member 107 causes the flavor releasing mechanism 104 to break apart (e.g., tear) as described with respect to the embodiment of FIG. 5.

It is understood that the mouthpiece body member 102 may include any hole(s) and/or opening(s) in any location(s) that the elongate movable member 107 may pass though, be pulled through, and/or be pushed into to activate the flavor releasing mechanism 104.

Cone 200

In some embodiments, once the mouthpiece assembly 100 has been formed as described above or otherwise, it may be used as a tip, a mouthpiece, a crutch, a filter, as any type of base for a blunt, cigar, pre-roll, cone, empty cone, cigarette, other type of smokable rod or cone 200, and for any combinations thereof as known in the art or otherwise. An example of this is shown in FIG. 1. For example, in some embodiments, the mouthpiece assembly 100 may be provided to manufacturers of blunts, pre-roll cones and/or cigarettes, of empty cones, etc. to be coupled to these types of products and then sold to consumers. In another example, the mouthpiece assembly 10) may be coupled with a smokable rod or cone 200 such as a blunt, pre-roll cone and/or cigarette, and/or to an empty cone during its manufacturing and made for sale to consumers as the combination (i.e., as the smokable system 10). In another example, the mouthpiece assembly 100 may be sold directly to consumers such that the consumers themselves may couple the mouthpiece assembly 100 with a leaf or rolling paper to form a smokable rod or cone 200 such as a cigarette, a cone, an empty cone, a cigar, a blunt, or other type of smokable item. It is understood that the examples described above are meant for demonstration and are non-limiting.

It is understood that any details and/or aspects of any embodiments of the assembly 100 and/or of the system 10 described herein may be combined with any other details and/or aspects of any other embodiments of the assembly 100 and/or of the system 10 in any way to form additional embodiment(s) of the assembly 100 and/or of the system 10 all of which are within the scope of the assembly 100 and/or of the system 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one". As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A mouthpiece system for use as a mouthpiece to a smokable item, the mouthpiece system comprising:

an elongate body member with a body first end and a body second end opposite the body first end, and an inner volume extending between the body first end and the body second end;

a flavor releasing mechanism located within the inner volume;

a force-applying member located within the inner volume and adjacent the flavor releasing mechanism; and an elongate movable member including a member first end coupled to the force-applying member and a member second end extending out the body first end;

wherein the force-applying member and the flavor releasing mechanism are unattached from each other; and wherein movement of the force-applying member relative to the flavor releasing mechanism causes the flavor releasing mechanism to release a flavor.

2. The mouthpiece system of claim 1 wherein the force-applying member is located between the flavor releasing mechanism and the body second end.

3. The mouthpiece system of claim 2 wherein movement of the elongate movable member first end toward the body first end causes the flavor releasing mechanism to release the flavor.

4. The mouthpiece system of claim 2 wherein the force-applying member includes a blade.

5. The mouthpiece system of claim 2 further comprising a first spacer located within the inner volume between the flavor releasing mechanism and the body first end.

6. The mouthpiece system of claim 5 wherein the elongate body member includes a first inward facing circumferential rim at its body first end.

7. The mouthpiece system of claim 5 further comprising a second spacer located within the inner volume between the flavor releasing mechanism and the body second end.

8. The mouthpiece system of claim 7 wherein the elongate body member includes a second inward facing circumferential rim at the body second end.

9. The mouthpiece system of claim 1 wherein the force-applying member is located between the flavor releasing mechanism and the body first end.

10. The mouthpiece system of claim 9 wherein movement of the elongate movable member away from the body first end causes the flavor releasing mechanism to burst.

11. The mouthpiece system of claim 9 wherein the force-applying member includes a spike.

12. The mouthpiece system of claim 1 wherein the flavor releasing mechanism includes a sphere filled with the flavor.

13. The mouthpiece system of claim 1 wherein the elongate movable member is adapted to break from the force-applying member when a force of predetermined magnitude is applied to the elongate movable member.

14. The mouthpiece system of claim 1 further comprising a smokable cone or smokable rod coupled to the body second end.

15. The mouthpiece system of claim 1 wherein the elongate body member is comprised entirely of glass.

16. A mouthpiece system for use as a mouthpiece to a smokable item, the mouthpiece system comprising:

an elongate body member with a body first end and a body second end opposite the first end, and an inner volume extending between the body first end and the body second end;

a flavor releasing mechanism located within the inner volume;

a force-applying member including a blade and located within the inner volume and adjacent the flavor releasing mechanism; and an elongate movable member including a member first end coupled to the force-applying member and a member second end extending out the body first end;

wherein movement of the force-applying member relative to the flavor releasing mechanism causes the flavor releasing mechanism to burst.

17. The mouthpiece system of claim 16 wherein the elongate body member is comprised entirely of glass.

* * * * *